US012398628B2

(12) United States Patent
Cook et al.

(10) Patent No.: US 12,398,628 B2
(45) Date of Patent: Aug. 26, 2025

(54) USING OPPOSING CHARGES TO BALANCE FORCE

(71) Applicant: Halliburton Energy Services, Inc., Houston, TX (US)

(72) Inventors: Jason Karl Cook, Corwley, TX (US); Matthew Craig Mlcak, Porter, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 129 days.

(21) Appl. No.: 18/126,733

(22) Filed: Mar. 27, 2023

(65) Prior Publication Data

US 2024/0328287 A1 Oct. 3, 2024

(51) Int. Cl.
*E21B 43/119* (2006.01)
*E21B 43/117* (2006.01)

(52) U.S. Cl.
CPC ..... *E21B 43/119* (2013.01); *E21B 43/117* (2013.01)

(58) Field of Classification Search
CPC .... E21B 43/116; E21B 43/117; E21B 43/118; E21B 43/119
See application file for complete search history.

(56) References Cited

U.S. PATENT DOCUMENTS 3,016,014 A * 1/1962 Lebourg ..... F42B 3/02 175/4.53
5,477,785 A * 12/1995 Dieman, Jr. ..... E21B 43/116 175/433
6,125,946 A * 10/2000 Chen ..... E21B 23/14 175/4.53
8,127,848 B2 3/2012 Myers, Jr. et al.
8,919,443 B2 12/2014 Parker et al.
2005/0247447 A1 11/2005 Spring et al.
2009/0159284 A1* 6/2009 Goodman ..... E21B 43/1195 166/297
2009/0242198 A1* 10/2009 Evans ..... E21B 43/119 175/4.51
2015/0267516 A1* 9/2015 Hardesty ..... E21B 43/119 175/3.5
2015/0368996 A1* 12/2015 Allison ..... E21B 43/117 166/55
2023/0212927 A1 7/2023 Cook et al.

FOREIGN PATENT DOCUMENTS

CN 201574736 U 9/2010

OTHER PUBLICATIONS

International Search Report and Written Opinion for International Patent Application No. PCT/US2023/018850 dated Dec. 18, 2023. PDF file. 7 pages.

(Continued)

*Primary Examiner* — David Carroll
(74) *Attorney, Agent, or Firm* — John Wustenberg; C. Tumey Law Group PLLC

(57) ABSTRACT

Systems and methods of the present disclosure relate to force-balanced perforating tools that employ opposing non-perpendicular shaped charge orientations. A perforating tool includes at least two shaped charges positioned to fire in opposing directions, wherein each shaped charged is oriented at an angle that is not perpendicular to a longitudinal axis of the perforating tool.

21 Claims, 5 Drawing Sheets

(56) References Cited

OTHER PUBLICATIONS

Scott, Martin; Carvajal, Gustavo A.; Manning, John Doug; Hendry, Nicholas Stuart; Rogers, Michael Clive (). [Society of Petroleum Engineers SPE Deepwater Drilling and Completions Conference—Galveston, Texas, USA (Oct. 5, 2010)] SPE Deepwater Drilling and Completions Conference—A New Multi-Jet Gun Improves Well Production in the North Sea: Triple-Jet Perforating System.

* cited by examiner

USING OPPOSING CHARGES TO BALANCE FORCE

BACKGROUND

After drilling various sections of a wellbore that traverse a subterranean formation, individual metal tubulars may be secured together to form a casing string that is cemented within the wellbore. The casing string may provide a path for fluids to flow from producing subterranean intervals to the surface. To allow the fluids into the casing string, the casing string may be perforated.

Typically, the perforations may be created by detonating a series of charges within the casing string. Specifically, one or more charge carriers may be loaded with the charges. The charge carriers may then be secured within a tool string that is lowered into the casing string. Once the charge carriers are positioned at a desired depth, the charges may be detonated. Upon detonation, the charges may form jets that may cause perforations through the casing string, the cement, and a portion of the subterranean formation.

BRIEF DESCRIPTION OF THE DRAWINGS

These drawings illustrate certain aspects of some examples of the present disclosure and should not be used to limit or define the disclosure.

DETAILED DESCRIPTION

The present disclosure relates to techniques for detonating charges that are positioned on opposing sides of the perforating tool at angles that are not perpendicular to a longitudinal axis of the perforating tool. Historically, charges are typically mounted perpendicular to the axis of the gun system. Charges that are not perpendicular to the axis of the gun system create forces to propel the system up or down the well. These forces and created motions can cause problems with conveyance methods, i.e., breaking or birdnesting the wireline, as well as tensile stress on tubing and connections. Therefore, by mounting some of the charges in opposing directions, one set of forces counteracts other forces. For example, upward facing charges create forces to resist the forces created by downward facing charges.

A force-balanced perforating gun system as described herein allows the charges to shoot in desired direction(s) relative to formation stress planes or other lithological features, without compromising/damaging the conveyance (e.g., wireline, slickline, braided cable, coiled tubing). This facilitates the ability to shoot charges at angles other than perpendicular to the tubing/casing axis as desired based on the formation lithology, i.e., in the direction of minimum stress in unconsolidated formations, thereby maximizing connectivity in the formation to drive increased production.

In some examples, the force-balanced perforating gun systems allow for shooting truly vertically upwards and downwards in a deviated well (e.g., 45° inclined well). In examples, the configurations of the charges include a multitude of angles, different quantity and ratio of upward and downward facing charges. The opposing charges may or may not include the same type, magnitude, quantity, and/or angle.

Figure 1:
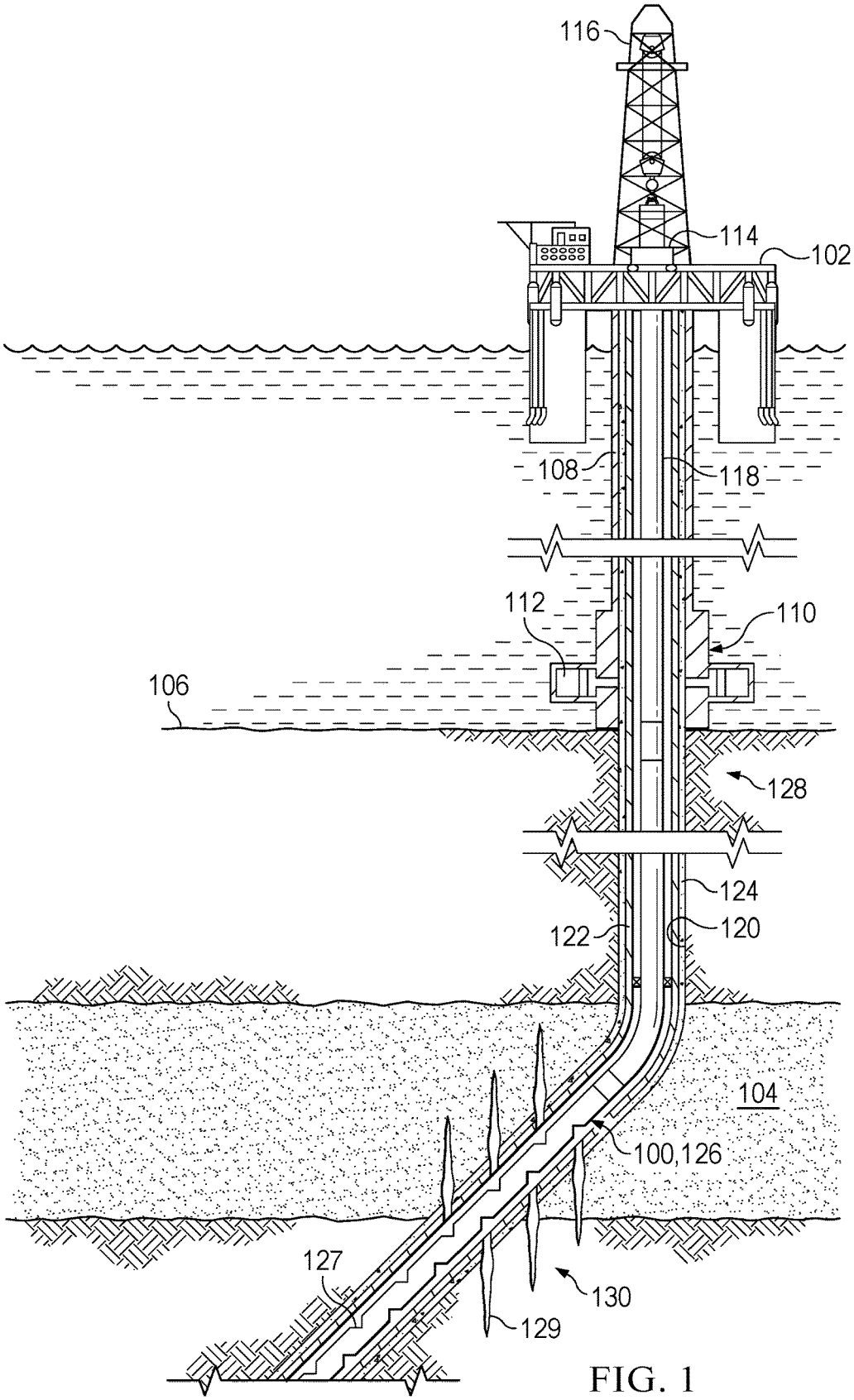
FIG. 1 illustrates an operating environment for a perforating tool, in accordance with examples of the present disclosure.

FIG. 1 illustrates an operating environment for a perforating tool 100, in accordance with examples of the present disclosure. A semi-submersible platform ("platform 102") may be centered over a submerged oil and gas formation 104 that may be located below a sea floor 106. A subsea conduit 108 may extend from the platform 102 to a wellhead installation 110 which may include subsea blow-out preventers 112. The platform 102 may include a hoisting apparatus 114 and a derrick 116 for raising and lowering pipe strings such as a conveyance 118 (e.g., a work string) which may include the perforating tool 100.

The conveyance 118 may include a wireline, slickline, coiled tubing, pipe, or downhole tractor, which may provide mechanical suspension, as well as electrical connectivity, for the perforating tool 100, for example. It should be understood that the configuration of the perforating tool 100 shown on FIG. 1 is merely illustrative and other configurations of the perforating tool 100 may be utilized with the present techniques. For example, although FIG. 1 depicts an offshore environment, systems and methods of the present disclosure may also be utilized onshore.

A wellbore 120 may extend through various earth strata including the formation 104. A casing string 122 may be cemented within the wellbore 120 by cement 124. The wellbore 120 may include an initial, generally vertical portion 128 and a lower, generally deviated portion 130 which is illustrated as being inclined roughly 45 degrees. It should be noted, however, by those skilled in the art that the perforating tool 100 may also be suited for use in other well configurations including, but not limited to, horizontal wells, wells with restrictions, non-deviated wells, and/or multilateral wells, for example.

The perforating tool 100 may include at least one perforating gun 126. Although illustrated with a single perforating gun, it should be noted that the perforating tool may include a plurality of perforating guns. For example, a gun string may include a plurality of connected perforating guns. To perforate the casing string 122, the perforating tool 100 may be lowered in the casing string 122 until the perforating gun 126 is properly positioned relative to the formation 104. The shaped charges 127 of the perforating tool 100 are oriented in opposing directions, such that one set of forces counteracts other forces.

Upward facing charges create forces to resist the forces created by downward facing charges. This force-balanced perforating gun system allows charges to shoot in a desired direction relative to the formation stress planes or other lithological features, without compromising/damaging the conveyance 118 (e.g., wireline, slickline, braided cable, coiled tubing). This facilitates the ability to shoot charges at angles other than perpendicular to the tubing/casing axis as desired based on the formation lithology, i.e., in the direction of minimum stress in unconsolidated formations, thereby maximizing connectivity in the formation to drive increased production.

The configurations of the angled charges allow for shooting truly vertically upwards and downwards in a deviated well (e.g., 45° inclined well). That is, each of the perforations 129 may intersect a subterranean formation layer (e.g., the formation 104) perpendicularly, due to the orientation of the shaped charges 127. After positioning the perforating tool 100 in the wellbore 120, the shaped charges 127 within the perforating gun 126 are detonated.

Upon detonation, liners of the shaped charges 127 may form a spaced series of perforations 129 extending outwardly through the casing string 122, the cement 124, and into the formation 104, thereby allowing fluid communication between the formation 104 and the wellbore 120. In some examples, the perforations 129 may extend in a true vertical direction to intersect formation layers perpendicularly. The perforations 129 may extend at angles other than perpendicular to a tubing/casing axis.

FIGS. 2A-2D illustrate example configurations of orientations of the shaped charges 127 of the perforating gun 126. At least two of the charges 127 are oriented in opposing directions (e.g., opposing sides of the tool), such that one set of forces counteracts the opposing forces. The shaped charges 127 are oriented at non-perpendicular angles. Upon detonation, upward facing charges create forces 200 to resist downward forces 202 created by downward facing charges. The shaped charges 127 may be retained in a charge tube 203 (e.g., a charge holder).

A detonator cord may contact each of the shaped charges 127. The charge tube 203 may be disposed in a gun body 206. The gun body 206 may include a sleeve containing scallops or recesses. Aligned with the recesses are the shaped charges 127. The firing of the shaped charges 127 may occur within microseconds of one another due to the use of a single detonator. Each of the shaped charges 127 may include a charge case and a liner. Explosive material may be disposed between the charge case and the liner.

In some examples, forces 207 and 208 may extend in directions of a longitudinal axis L of the perforating gun 126. As noted above, the orientation of the shaped charges 127 (i.e., not perpendicular to the longitudinal axis of the perforating tool) allows the charges to be shot in a desired direction relative to formation stress planes or other lithological features, without compromising/damaging the conveyance. This allows the shaped charges 127 to be positioned/oriented at angles other than perpendicular to the tubing/casing axis (e.g., L) as desired based on the formation lithology, i.e., in the direction of minimum stress in unconsolidated formations, thereby maximizing connectivity in the formation to drive increased production.

Figure 2A:
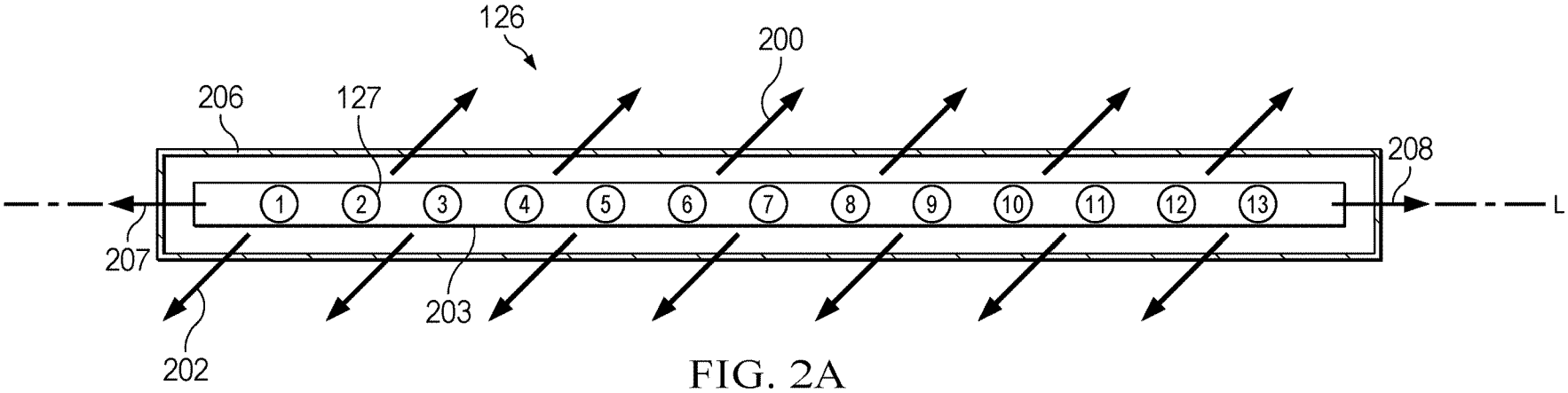
FIGS. 2A and 2B illustrate different configurations of opposing shaped charges positioned on the perforating tool, in accordance with examples of the present disclosure.
Figure 2B:
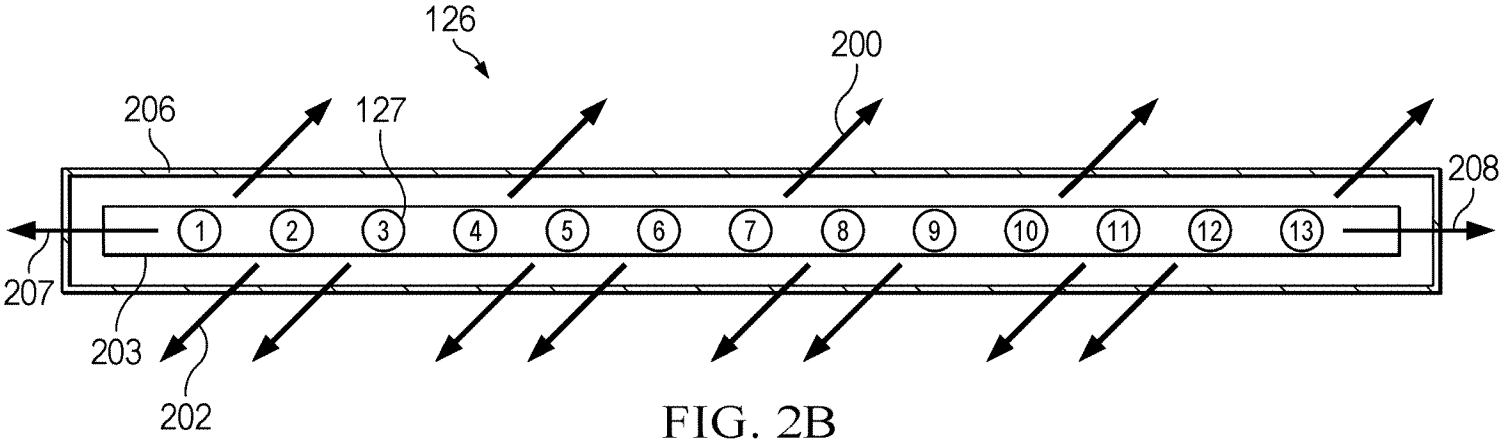
Figure 2C:
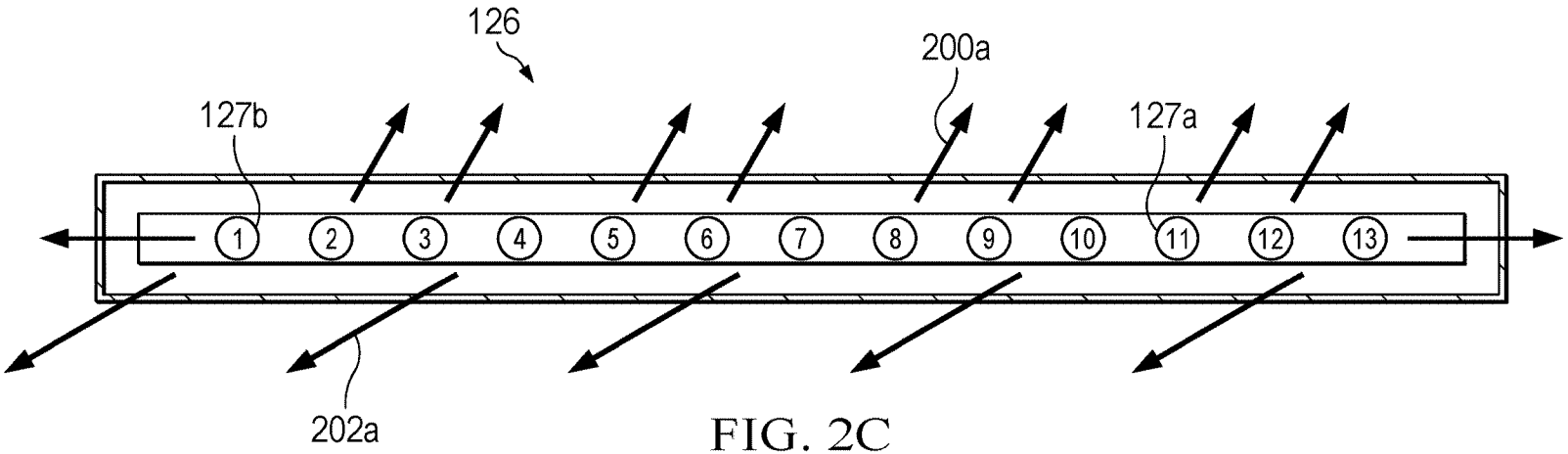
FIG. 2C illustrates the opposing shaped charges positioned at different non-perpendicular angles, in accordance with examples of the present disclosure.
Figure 2D:
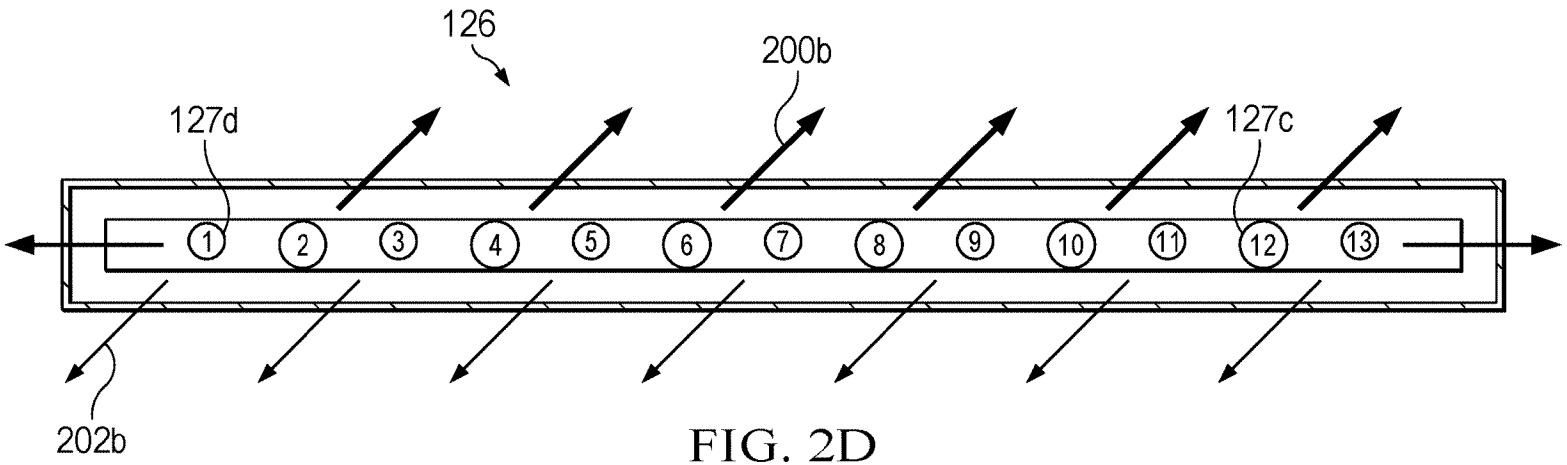
FIG. 2D illustrates the opposing shaped charges having different magnitudes, in accordance with examples of the present disclosure.

The orientation of shaped charges 127 may be configured for shooting truly vertically upwards and downwards in a deviated well. In examples, the configurations of the charges 127 include a multitude of angles, placement, and a different quantity and ratio of upward and downward facing charges. The opposing charges may or may not include the same type, magnitude, quantity, and/or angle. FIG. 2C illustrates a configuration that includes opposing shaped charges positioned on the perforating gun 126 at different non-perpendicular angles. For example, a shaped charge 127*a* may be positioned at an angle (e.g., 60°) that is different than an angle for a shaped charge 127*b* (e.g., 30°). A force 200*a* is created with a shaped charge 127*a*. A force 202*a* is created with a shaped charge 127*b*. FIG. 2D illustrates different shaped charges such as a shaped charge 127*c* and a shaped charge 127*d* that may have different magnitudes and/or be different types to create different forces. The shaped charge 127*c* may create a force 200*b*, and the shaped charge 127*d* may create a force 202*b*.

Figure 3A:
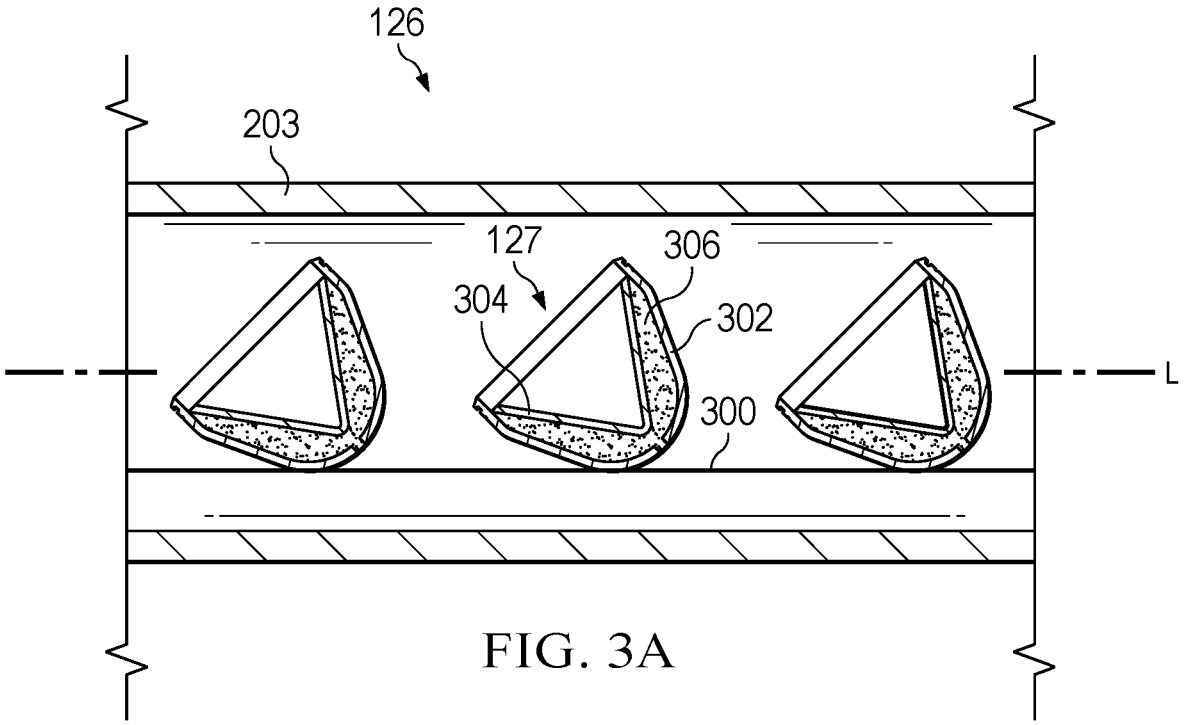
FIG. 3A illustrates shaped charges mounted/oriented at 45° relative to a longitudinal axis of the perforating tool, in accordance with examples of the present disclosure.
Figure 3B:
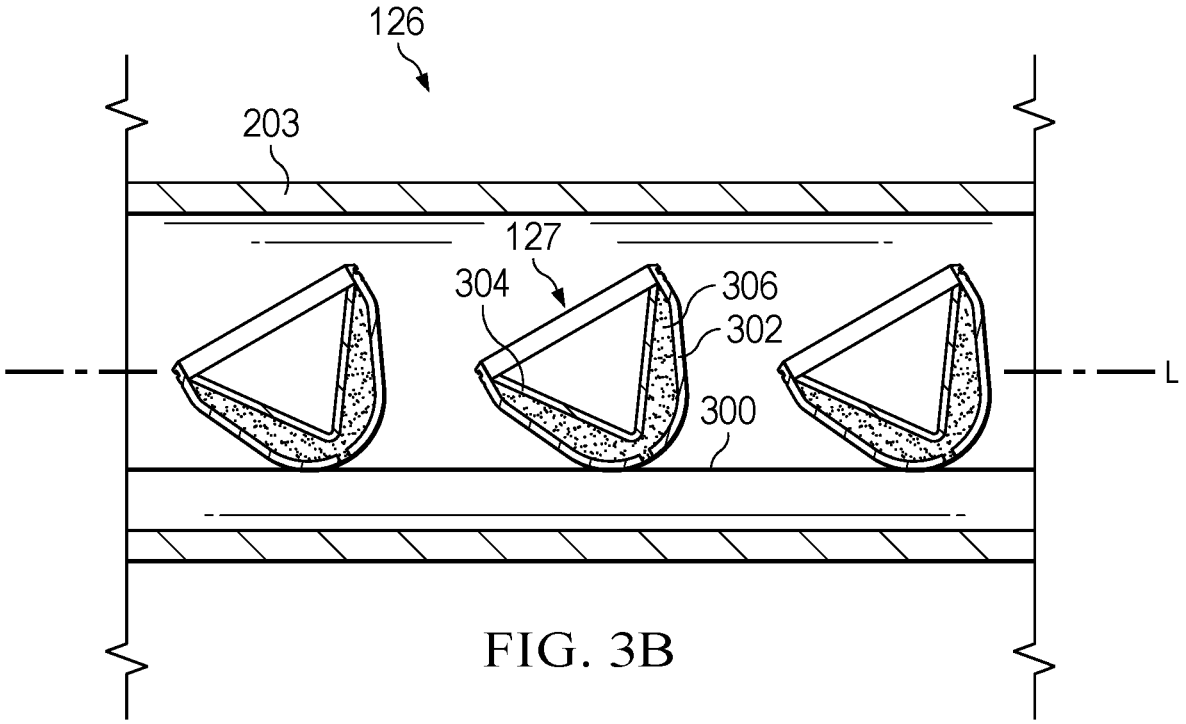
FIG. 3B illustrates shaped charges mounted/oriented at 60° relative to a longitudinal axis of the perforating tool, in accordance with examples of the present disclosure.

FIGS. 3A and 3B illustrate examples of a perforating gun 126 with non-perpendicular orientations for the shaped charges 127 disposed in the charge tube 203 of the gun 126, relative to longitudinal axis L of the gun 126 (or casing). Each perforating gun 126 may house any number of shaped charges 127. A detonator cord 300 connects the shaped charges 127 and a detonator is used to detonate/fire the shaped charges 127. These configurations allow for firing of the shaped charges 127 in opposing directions to urge balancing of forces.

FIG. 3A illustrates a 45° orientation and FIG. 3B illustrates a 60° orientation relative to L. Although illustrated as upward facing charges, these orientations may be used for upward and/or downward facing charges. It should be noted that these angles are non-limiting examples, and any angle that is not perpendicular to L may be used for shaped charge orientation. Also, a combination of different or similar angles may be used for firing the shaped charges in opposing directions. Each of the shaped charges 127 may include a charge case 302 and a liner 304. Explosive material 306 may be disposed between the charge case 302 and the liner 304.

Figure 4:
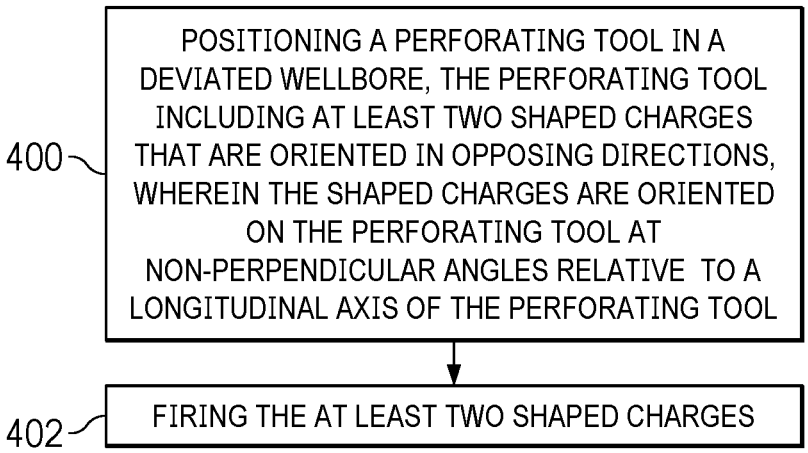
FIG. 4 illustrates an operative sequence for the perforating tool, in accordance with examples of the present disclosure.

FIG. 4 illustrates an operative sequence to perforate a wellbore such as a deviated section of the wellbore, for example. At step 400, a force-balanced perforating gun system (e.g., perforating tool 100) is disposed in a deviated wellbore. For example, the perforating guns may be incorporated into a tool string that is lowered into a cased wellbore at the end of a conveyance (e.g., tubing string, wireline, slickline, coiled tubing).

The perforating guns may be positioned in the wellbore as desired (e.g., inclined section, 45° incline), such that the shaped charges are facing target formation(s). The perforating guns include at least two shaped charges that are oriented in opposing directions that may allow for shooting truly vertically upwards and downwards in a deviated well, minimizing damage to the conveyance, and/or shooting in the direction of minimum stress in unconsolidated formations.

At step 402, the shaped charges may be fired to create perforations in the subterranean formation. For example, the at least two shaped charges are fired at angles other than perpendicular to the tubing/casing axis as desired based on the formation lithology, i.e., in the direction of minimum stress in unconsolidated formations, thereby maximizing connectivity in the formation to drive increased production. As noted above, this may include a multitude of angles, placement, and a different quantity and ratio of upward and downward facing charges. The opposing charges may or may not include the same type, magnitude, quantity, and/or angle.

Accordingly, the force-balanced perforating gun systems and methods of the present disclosure employ opposing non-perpendicular shaped charge orientations to maximize connectivity in deviated wellbores to drive increased hydrocarbon production, as well as minimize damage to the conveyance. The systems and methods may include any of the various features disclosed herein, including one or more of the following statements.

Statement 1. A perforating tool comprising at least two shaped charges positioned to fire in opposing directions, wherein each shaped charged is oriented at an angle that is not perpendicular to a longitudinal axis of the perforating tool.

Statement 2. The tool of the statement 1, wherein at least one shaped charge is oriented in a direction of the longitudinal axis.

Statement 3. The tool of any one of the preceding statements, wherein at least one shaped charge is oriented upward.

Statement 4. The tool of any one of the preceding statements, wherein at least one shaped charge is oriented downward.

Statement 5. The tool of any one of the preceding statements, wherein the angles are different for the at least two shaped charges.

Statement 6. The tool of any one of the preceding statements, wherein at least one shaped charge is oriented upward or downward, and wherein at least one shaped charge is oriented in a direction of the longitudinal axis.

Statement 7. The tool of any one of the preceding statements, wherein a magnitude of each shaped charge is different.

Statement 8. The tool of any one of the preceding statements, wherein a magnitude of each shaped charge is the same.

Statement 9. The tool of any one of the preceding statements, wherein at least one shaped charge is oriented downward, and wherein at least one shaped charge is oriented in a direction of the longitudinal axis.

Statement 10. The tool of any one of the preceding statements, wherein at least one shaped charge is oriented upward and wherein at least one shaped charge is oriented downward.

Statement 11. A method comprising: positioning a perforating tool in a wellbore, the perforating tool comprising at least two shaped charges positioned to fire in opposing directions, wherein each shaped charged is oriented at an angle that is not perpendicular to a longitudinal axis of the perforating tool.

Statement 12. The method of the statement 11, wherein the perforating tool is disposed in an inclined section of a wellbore.

Statement 13. The method of any one of the statements 11 or 12, wherein at least one shaped charge is oriented upward.

Statement 14. The method of any one of the statements 11-13, wherein at least one shaped charge is oriented in a direction of the longitudinal axis.

Statement 15. The method of any one of the statements 11-14, wherein at least one shaped charge is oriented downward.

Statement 16. The method of any one of the statements 11-15, wherein the angles are different for the at least two shaped charges.

Statement 17. The method of any one of the statements 11-16, wherein at least one shaped charge is oriented upward or downward, and wherein at least one shaped charge is oriented in a direction of the longitudinal axis.

Statement 18. The method of any one of the statements 11-17, wherein a magnitude of each shaped charge is different.

Statement 19. The method of any one of the statements 11-18, wherein a magnitude of each shaped charge is the same.

Statement 20. The method of any one of the statements 11-19, wherein at least one shaped charge is oriented downward, and wherein at least one shaped charge is oriented in a direction of the longitudinal axis.

Statement 21. The method of any one of the preceding statements, wherein at least one shaped charge is of a different type than other charges in the system. For example, a Deep Penetrating charge oriented upward and a Big Hole charge or a Limited Entry charge oriented downward.

Although the present disclosure and its advantages have been described in detail, it should be understood that various changes, substitutions and alterations may be made herein without departing from the spirit and scope of the disclosure as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A perforating tool, comprising:

a first group of charges having each charge secured to a first circumferential side of the perforating tool, wherein each charge of the first group of charges is oriented in a direction non-perpendicular to a longitudinal axis of the perforating tool, wherein each charge of the first group of charges is oriented in a partially longitudinally downward direction with respect to the perforating tool, wherein each charge of the first group of charges is configured to generate a force in a corresponding direction based on an orientation of the respective charge upon detonation; and a second group of charges having each charge secured to a second circumferential side of the perforating tool, wherein each charge of the second group of charges is oriented in a partially longitudinally upward direction with respect to the perforating tool, wherein each charge of the second group of charges is configured to generate a force in a corresponding direction based on an orientation of the respective charge upon detonation, wherein the second group of charges are oriented with respect to the first group of charges such that the forces generated by the second group of charges are configured to laterally and longitudinally offset the forces generated by the first group of charges to thereby prevent or mitigate damage to a conveyance.

2. The perforating tool of claim 1, wherein the first group of charges has the same number of charges as the second group of charges.

3. The perforating tool of claim 1, wherein the first group of charges has a greater number of charges than the second group of charges.

4. The perforating tool of claim 1, wherein the first group of charges consists of an even number of charges, and wherein the second group of charges consists of an odd number of charges.

5. The perforating tool of claim 1, wherein at least one charge of the first group of charges has a different amount of explosive material than at least one charge of the second group of charges.

6. The perforating tool of claim 1, wherein a type of each of the charges of the first and second groups of charges is the same.

7. The perforating tool of claim 1, wherein a type of at least one charge of the first group of charges is different from that of at least one charge of the second group of charges.

8. The perforating tool of claim 1, wherein the first group of charges consists of six charges, and wherein the second group of charges consists of seven charges.

9. The perforating tool of claim 1, wherein:

at least one charge of the first group of charges has a different magnitude than at least one charge of the second group of charges to ensure that the force balance is zero, and wherein the first group of charges comprises more charges than the second group of charges and/or the first direction and the second direction are not directly opposite to each other.

10. A method, comprising:

lowering a perforating tool on a conveyance into a wellbore extending into a subterranean formation, wherein the perforating tool comprises:

a first group of charges having each charge secured to a first circumferential side of the perforating tool, wherein each charge of the first group of charges is oriented in a direction non-perpendicular to a longitudinal axis of the perforating tool, wherein each charge of the first group of charges is oriented in a partially longitudinally downward direction with respect to the perforating tool, wherein each charge of the first group of charges is configured to generate a force in a corresponding direction based on an orientation of the respective change upon detonation; and a second group of charges having each charge secured to a second circumferential side of the perforating tool, wherein each charge of the second group of charges is oriented in a partially longitudinally upward direction with respect to the perforating tool, wherein each charge of the second group of charges is configured to generate a force in a corresponding direction based on an orientation of the respective charge upon detonation, wherein the second group of charges are oriented with respect to the first group of charges such that the forces generated by the second group of charges are configured to laterally and longitudinally offset the forces generated by the first group of charges;

to thereby prevent or mitigate damage to the conveyance; and detonating the first and the second group of charges without damaging the conveyance.

11. The method of claim 10, further comprising selecting the perforating tool based on a stress gradient of a subterranean formation.

12. The method of claim 10, further comprising selecting the perforating tool based on a difference between a slant angle of a deviated wellbore and a true vertical of a subterranean formation.

13. The method of claim 10, wherein the first group of charges comprises an even number of charges, and wherein the second group of charges comprises an odd number of charges.

14. The method of claim 13, wherein the first group of charges consists of six charges, and wherein the second group of charges consists of seven charges.

15. The method of claim 10, wherein:

at least one charge of the first group of charges has a different magnitude than at least one charge of the second group of charges to ensure that the momentum balance is zero, and wherein the first group of charges comprises more charges than the second group of charges and/or the first group of charges and the second group of charges are not oriented directly opposite to each other.

16. The method of claim 10, wherein the first group of charges has the same number of charges as the second group of charges.

17. The method of claim 10, wherein the first group of charges has a greater number of charges than the second group of charges.

18. The method of claim 10, wherein the first group of charges and the second group of charges are not oriented directly opposite to each other.

19. The method of claim 10, wherein a magnitude of each of the charges of the first and second groups of charges are the same.

20. The method of claim 10, wherein a magnitude of at least one charge of the first group of charges is different from at least one charge of the second group of charges.

21. A system, comprising:

a wellbore extending into a subterranean formation;

a conveyance disposed in the wellbore; and a perforating tool disposed on the conveyance, wherein the perforating tool comprises:

a first group of charges having each charge secured to a first circumferential side of the perforating tool, wherein each charge of the first group of charges is oriented in a direction non-perpendicular to a longitudinal axis of the perforating tool, wherein each charge of the first group of charges is oriented in a partially longitudinally downward direction with respect to the perforating tool, wherein each charge of the first group of charges is configured to generate a force in a corresponding direction based on an orientation of the respective charge upon detonation; and a second group of charges having each charge secured to a second circumferential side of the perforating tool, wherein each charge of the second group of charges is oriented in a partially longitudinally upward direction with respect to the perforating tool, wherein each charge of the second group of charges is configured to generate a force in a corresponding direction based on an orientation of the respective charge upon detonation, wherein the second group of charges are oriented with respect to the first group of charges are such that the forces generated by the second group of charges are configured to laterally and longitudinally offset forces generated by the first group of charges to thereby prevent or mitigate damage to the conveyance, wherein at least one charge of the first group of charges is characterized by an asymmetric firing magnitude or firing angle relative to at least one charge of the second group of charges, or wherein the first group of charges has an asymmetric number of charges than the second group of charges.

* * * * *